US009954313B2

(12) United States Patent
Miyamura

(10) Patent No.: US 9,954,313 B2
(45) Date of Patent: Apr. 24, 2018

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Tetsuya Miyamura, Mie (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 15/544,616

(22) PCT Filed: Jan. 18, 2016

(86) PCT No.: PCT/JP2016/051214
§ 371 (c)(1),
(2) Date: Jul. 19, 2017

(87) PCT Pub. No.: WO2016/125566
PCT Pub. Date: Aug. 11, 2016

(65) Prior Publication Data

US 2018/0019540 A1 Jan. 18, 2018

(30) Foreign Application Priority Data

Feb. 6, 2015 (JP) ..... 2015-021883

(51) Int. Cl.
*H01R 13/627* (2006.01)
*H01R 13/629* (2006.01)

(52) U.S. Cl.
CPC ..... *H01R 13/629* (2013.01); *H01R 13/6272* (2013.01)

(58) Field of Classification Search
CPC ..... H01R 13/629; H01R 13/6314; H01R 13/6273; H01R 13/353; H01R 13/6272; G02B 6/3849; G02B 6/382
(Continued)

(56) References Cited

U.S. PATENT DOCUMENTS 5,984,705 A 11/1999 Miyazaki et al.
6,296,508 B1 * 10/2001 Kuwahara ..... H01R 13/6273 439/353

(Continued)

FOREIGN PATENT DOCUMENTS

JP 10-162896 6/1998
JP 2000-150065 5/2000

(Continued)

OTHER PUBLICATIONS

International Search Report dated Mar. 29, 2016.

*Primary Examiner* — Jean F Duverne
(74) *Attorney, Agent, or Firm* — Gerald E. Hespos; Michael J. Porco; Matthew T. Hespos

(57) ABSTRACT

A receptacle (12) of a male housing (10) has a cut (18) that communicates with an opening (17) at a front of the receptacle. First and second guide grooves (21, 22) are formed in an inner surface of the receptacle (12). The first guide groove (21) extends in a front-rear direction from a position behind a front end of the receptacle (12) toward a back end of the cut (18). The second guide groove (22) extends in a direction intersecting the first guide groove (21) from a front end of the first guide groove (21) toward the cut (18). A follower (32) on an outer surface of the female housing (30) guides the female housing (30) from a proper connection position to the male housing (10) to the cut (18) by successively (Continued)

sliding in contact with the first guide groove (21) and the second guide groove (22).

4 Claims, 9 Drawing Sheets

(58) Field of Classification Search
USPC ..... 439/354
See application file for complete search history.

(56) References Cited

U.S. PATENT DOCUMENTS

| | | | | |
|---|---|---|---|---|
| 7,993,063 | B2 * | 8/2011 | Hackett | G02B 6/3849 385/58 |
| 8,011,942 | B2 * | 9/2011 | Ohmori | H01R 13/6315 439/314 |
| 8,224,146 | B2 * | 7/2012 | Hackett | G02B 6/3825 385/134 |

FOREIGN PATENT DOCUMENTS

| | | |
|---|---|---|
| JP | 2004-273323 | 9/2004 |
| JP | 2014-207102 | 10/2014 |

* cited by examiner

CONNECTOR

BACKGROUND

1. Field of the Invention

The present invention relates to a connector.

2. Description of the Related Art

Japanese Unexamined Patent Publication No. 2014-207102 discloses a connector assembly that has a female connector formed with a lock arm and a male connector including a receptacle formed with a lock receiving portion. in the lock receiving portion interferes with the lock arm in the process of connecting the connectors and causes the lock arm to deflect resiliently. The lock arm resiliently returns when the male and female connectors are connected properly to lock the lock receiving portion so that the male and female connectors are locked in a connected state.

In the above connector, an operating portion for unlocking is formed on the lock arm for unlocking the male and female connectors in the connected state. The operating portion is exposed to outside when the male and female connectors are locked in the connected state so that a worker can easily perform an unlocking operation. A mechanic should be able to separate the male and female connectors easily for maintenance or other purpose when the connector constitutes part of a wiring harness of an automotive vehicle. However, if the unlocking operation is easy, a general user can easily separate the male and female connectors. Thus, an improvement is desired.

The invention was developed in view of the above situation and aims to prevent a connector in a connected state from being separated easily.

SUMMARY

The invention is directed to a connector with a male housing. A receptacle is formed in the male housing and has a front opening. A female housing is fit into the receptacle to close the opening. A cut portion is formed by cutting a part of a peripheral wall of the receptacle to communicate with the opening and is configured to allow the passage of the female housing. A lock is capable of locking the male housing and the female housing in a properly connected state and also unlocking the male and female housings. A first guide groove is formed in an inner surface of the receptacle and extends in a front-rear direction from a position behind a front end of the receptacle toward a back end of the receptacle. A second guide groove is formed in the inner surface of the receptacle and extends in a direction intersecting with the first guide groove from a front end part of the first guide groove toward the cut. A follower is formed on an outer surface of the female housing and is configured to guide the female housing from a proper connection position to the male housing to the cut portion by successively sliding in contact with the first guide groove and the second guide groove.

According to this configuration, in separating the housings, the lock is unlocked to separate the housings and the female housing is slid toward the front end of the receptacle along the first guide groove. Further forward movement of the female housing is restricted when the follower reaches the front end of the first guide groove. Thus, a general user or the like who does not recognize a guiding structure composed of the first and second guide grooves cannot easily separate the housings even if being able to unlock the lock means. In contrast, a mechanic or the like who recognizes the guiding structure composed of the first and second guide grooves can separate the female housing from the male housing by sliding the female housing toward the cut and causing the female housing to pass through the cut after the follower reaches the front of the first guide groove.

The first guide groove and the second guide groove may communicate at a right or acute angle. If the first and second guide grooves communicate at an obtuse angle, the follower that has reached the front end of the first guide groove may be guided to the second guide groove by a forward operating force applied to the female housing. However, since the first and second guide grooves communicate at a right or acute angle, there is no possibility that the follower is guided to the second guide groove.

A recess may be formed in the front end part of the first guide groove and may extend farther forward than a communication position with the second guide groove. According to this configuration, if the female housing is slid forward from a state where the housings are connected, a forward movement of the female housing is stopped when the follower reaches the recess after passing a communication position with the second guide groove. The follower cannot enter the second guide groove in this state. Thus, a general user or the like who does not recognize the presence of the recess cannot slide the female housing toward the cut.

DETAILED DESCRIPTION

Hereinafter, one specific embodiment of the invention is described with reference to FIGS. 1 to 9. A connector of this embodiment is used for connecting wiring harnesses of an automotive vehicle or for connecting a device and a wiring harness. The connector includes a male housing 10 and a female housing 30 connectable to and separable from each other. Note that, in the following description, front and rear ends are defined based on the male housing 10 concerning a front-rear direction. Left and right sides are defined based on an orientation of the male housing 10 viewed from behind concerning a lateral direction.

The male housing 10 is formed integrally of synthetic resin to include a block-shaped terminal holding portion 11 and a receptacle 12 in the form of a rectangular tube cantilevered forward from the outer periphery of the front end of the terminal holding portion 11. Male terminal fittings (not shown) of a known form are mounted in the terminal holding portion 11 and have long and narrow tabs formed on front end parts. The tabs project into the receptacle 12 from the front surface of the terminal holding portion 11.

Figure 1:
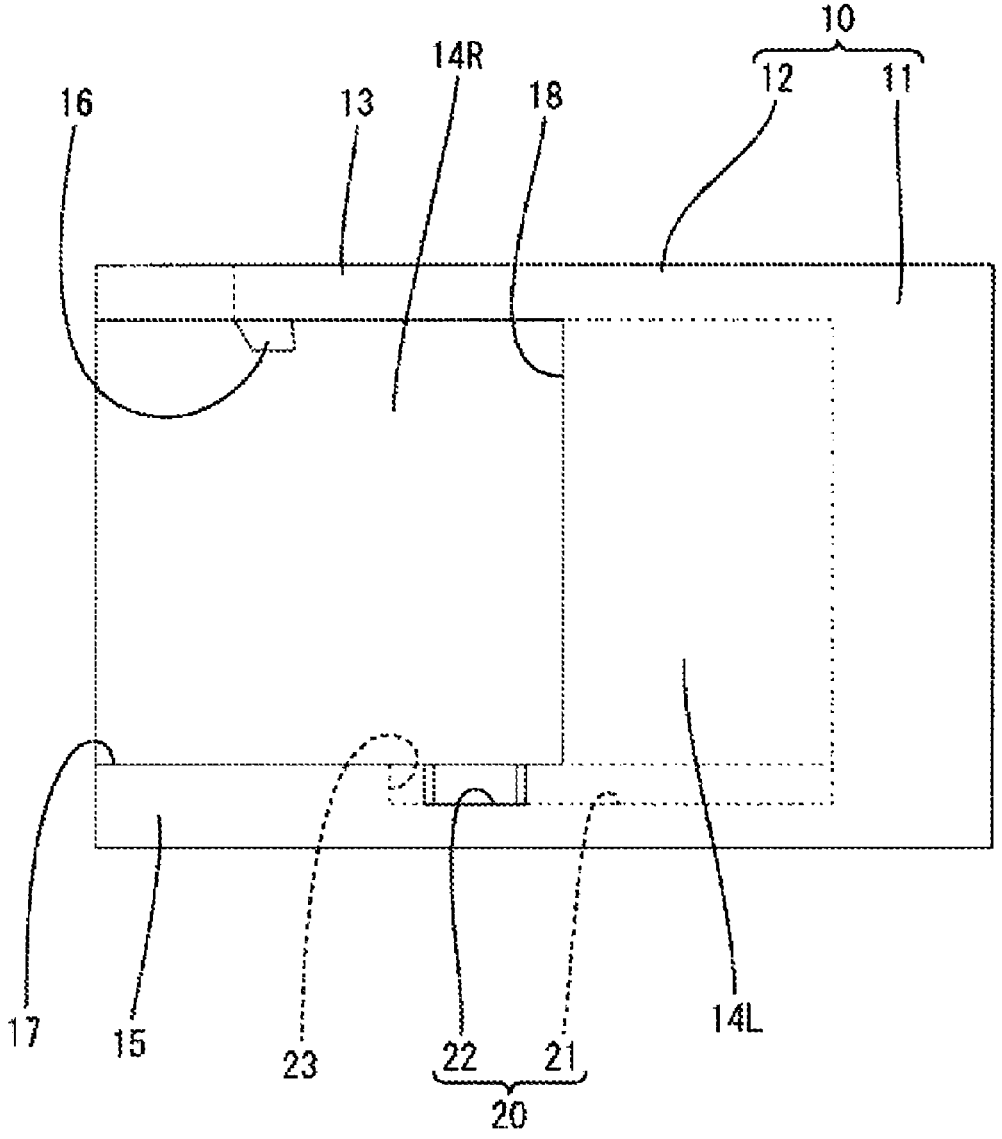
FIG. 1 is a side view of a male housing constituting a connector of one embodiment.
Figure 2:
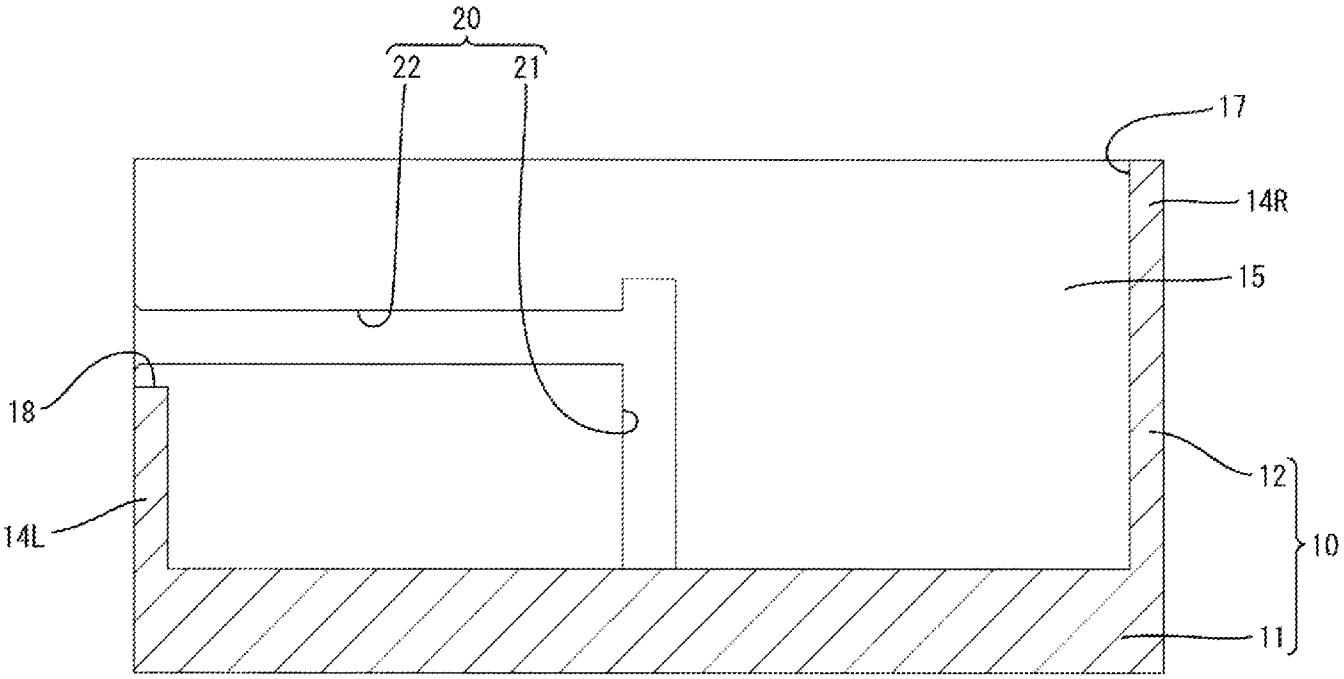
FIG. 2 is a plan view in section of the male housing.
Figure 5:
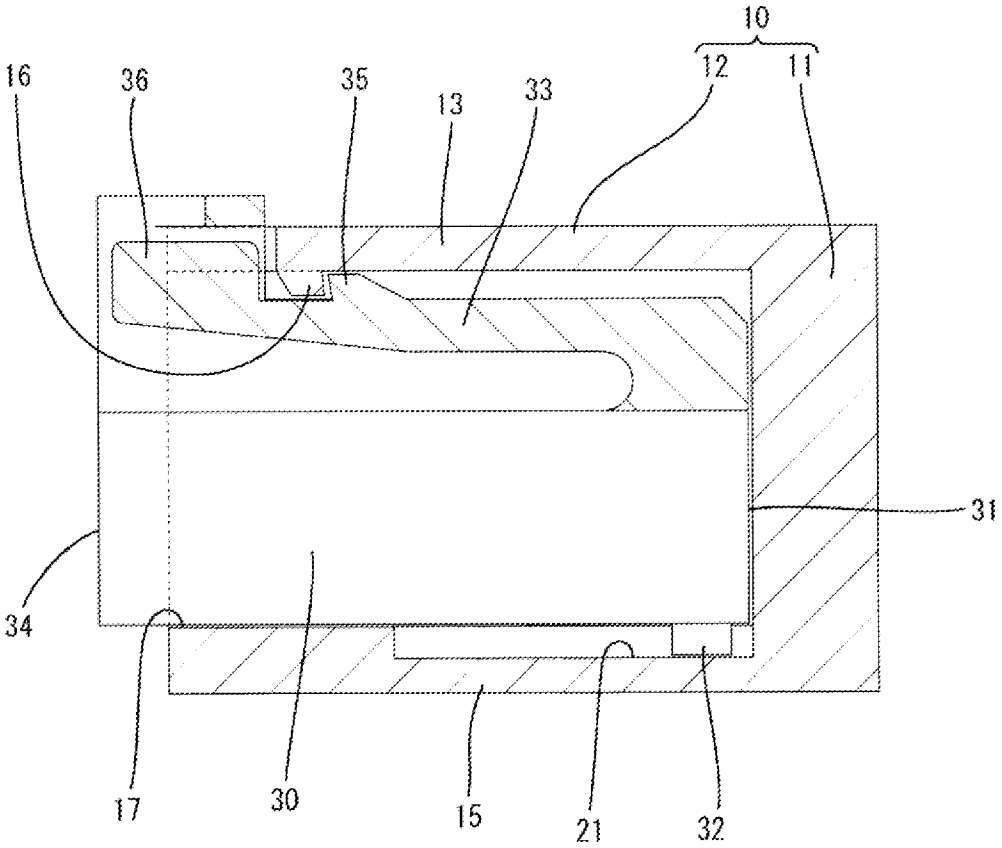
FIG. 5 is a side view in section showing a state where the male and female housings are properly connected.

The receptacle 12 is molded into a rectangular tube shape with an upper wall 13, a left wall 14L (peripheral wall as claimed), a right wall 14R and a lower wall 15. As shown in FIGS. 1 and 5, a lock 16 is formed on the inner surface (lower surface) of the upper wall 13. The front surface of the receptacle 12 is open in its entire area to define a rectangular opening 17. As shown in FIGS. 1 and 2, a rectangular cut 18 is formed in the left wall 14L to communicate with the left end of the opening 17. The cut 18 is open vertically from the lower surface of the upper wall 13 to the upper surface of the lower wall 15. in the cut 18 extends in the front-rear direction from the front end of the receptacle 12 to an area in front of the rear ends of the terminal fittings (front end of the terminal holding portion 11). The rear end of the cut 18 is located slightly in front of the front ends of the tabs.

As shown in FIG. 2, a guide path 20 is formed in the upper surface of the lower wall 15 (inner surface of the receptacle 12) and is substantially L-shaped in a plan view. The guide path 20 is composed of a first guide groove 21 and a second guide groove 22 communicating at a right angle. The first guide groove 21 is arranged at a central position of the receptacle 12 in the lateral direction and extends straight in the front-rear direction. A formation range of the first guide groove 21 in the front-rear direction is an area from a position behind the front end of the receptacle 12 to the rear end of the receptacle 12. A front part of the first guide groove 21 defines a dead-end recess 23.

The second guide groove 22 extends straight left toward the cut 18 from a position slightly behind the recess 23 in the front part of the first guide groove 21. The right end of the second guide groove 22 communicates with the front end part of the first guide groove 21. The left end of the second guide groove 22 reaches the cut 18 and is open on the left edge of the lower wall 15. The second guide groove 22 is arranged in an area slightly in front of the front ends of the tabs.

Figure 4:
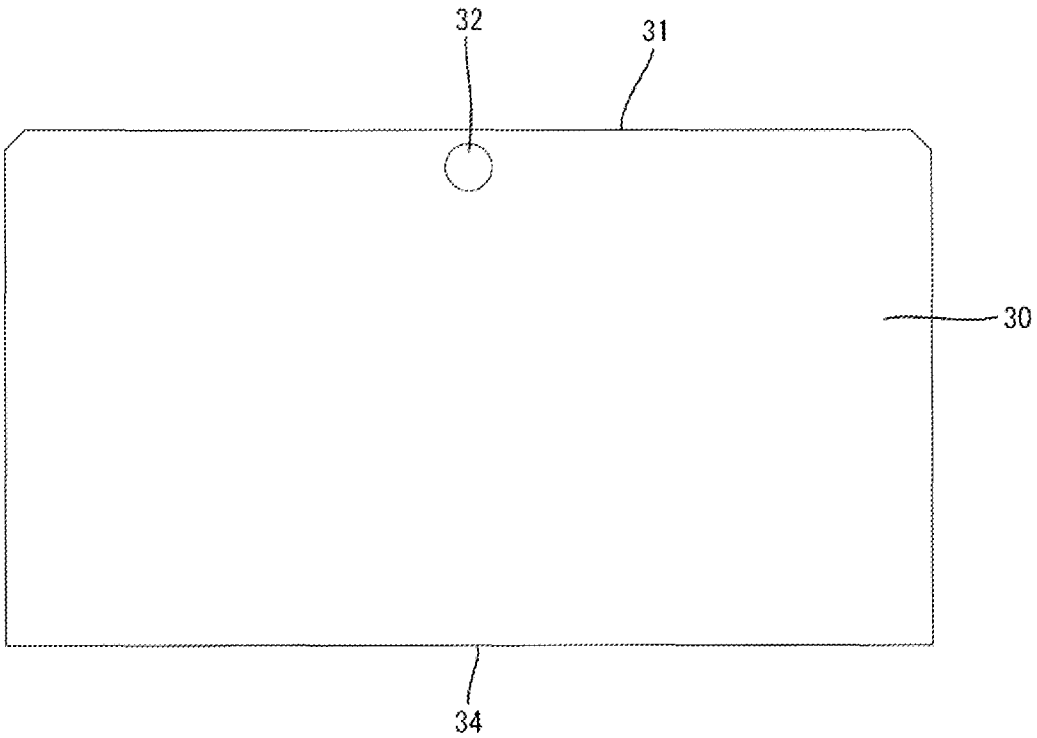
FIG. 4 is a bottom view of the female housing.

The female housing 30 is made of synthetic resin and is block-shaped. Female terminal fittings (not shown) of a known form are accommodated in the female housing 30 and are connectable to the male terminal fittings. The female housing 30 is connected to the male housing 10 with a front surface 31 thereof facing the front surface of the male housing 10 (opening 17 of the receptacle 12). As shown in FIGS. 4 and 5, a cylindrical follower 32 projects on the lower surface of the female housing 30. The follower 32 is arranged at a position near the front surface 31 of the female housing 30. Further, the follower portion 32 is arranged at a laterally central position.

Figure 3:
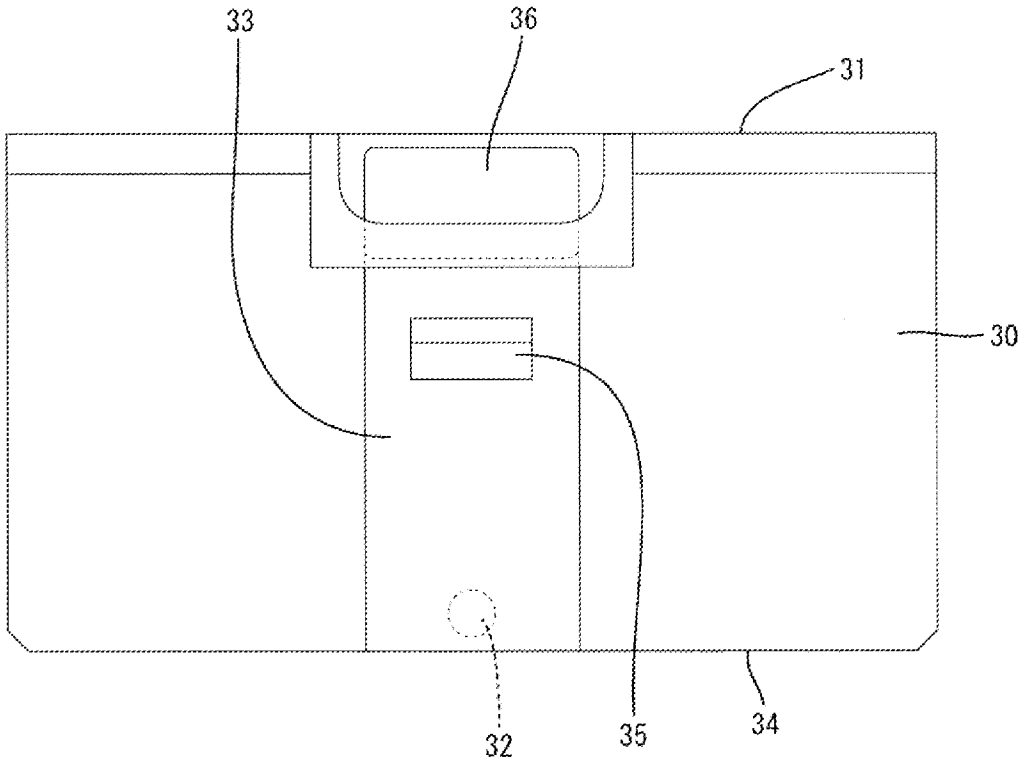
FIG. 3 is a plan view of a female housing.

As shown in FIGS. 3 and 5, a lock arm 33 is formed on the upper surface of the female housing 30. The lock arm 33 is supported on an end part of the upper surface of the female housing 30 on the side of a back surface 34 and is cantilevered toward the front surface 31. A lock projection 35 is formed on the upper surface of the lock arm 33 and is lockable to the lock 16. An operating portion 36 for unlocking the lock projection 35 and the lock 16 is formed on an extending end part (end part on the side of the front surface 31) of the lock arm 33.

Figure 6:
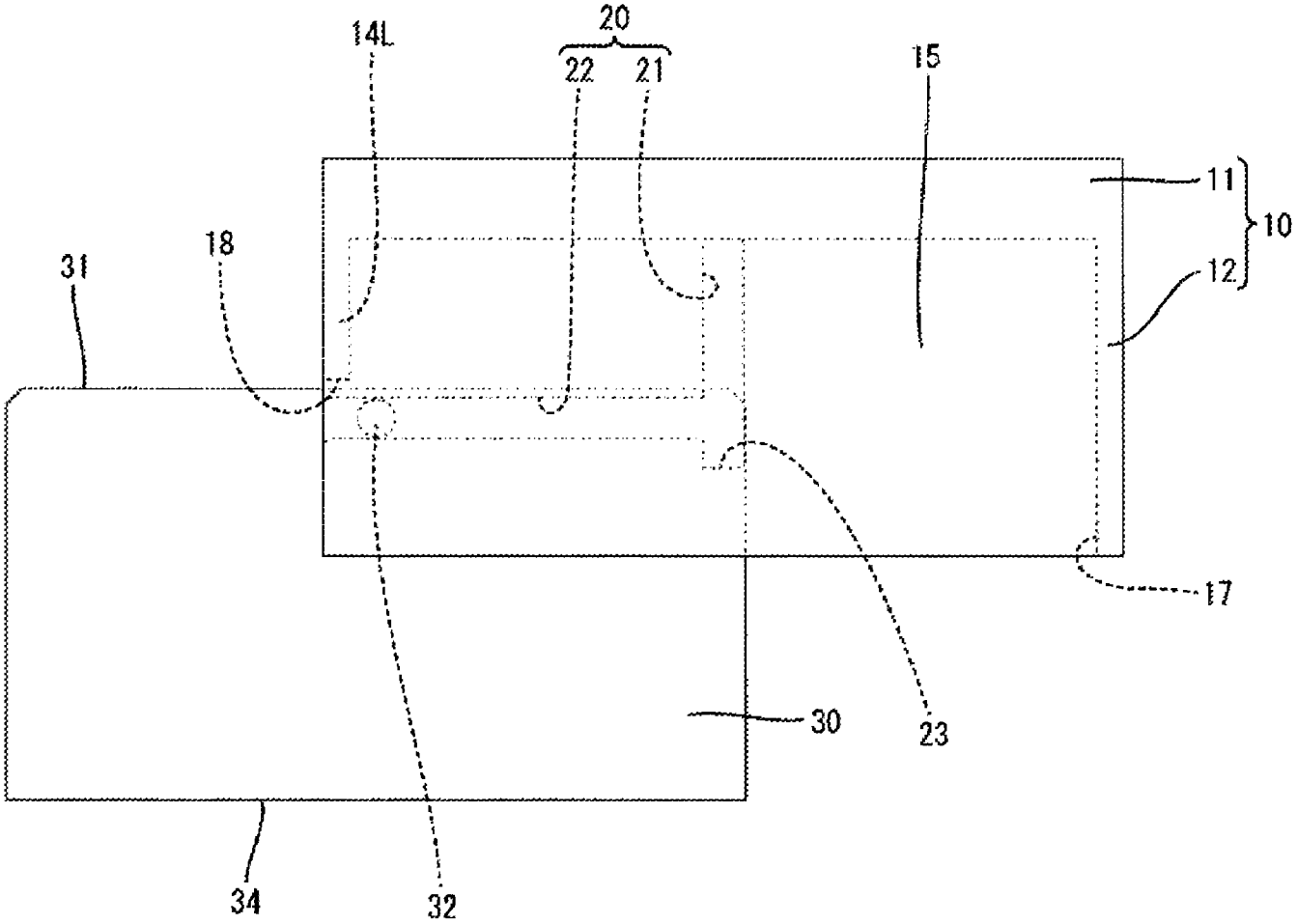
FIG. 6 is a bottom view showing a state where the connection of the female housing to the male housing is started.

Next, functions of this embodiment are described. In connecting the housings 10 and 30, the follower portion 32 is inserted into a left end part of the second guide groove with the front surface 31 of the female housing 30 displaced slightly (substantially about half the width of the female housing 30) left with respect to the opening 17 of the receptacle 12. At this time, as shown in FIG. 6, the female housing 30 is fit into the cut 18, a substantially right half area of the female housing 30 is inserted into the receptacle 12 and a substantially left half area of the female housing 30 projects out leftward from the receptacle 12. Further, an area of the female housing 30 on the side of the rear surface 34 projects forward from the receptacle 12.

Thereafter, the female housing 30 is pushed right and accommodated into the receptacle 12. During this time, the follower 32 moves in the second guide groove 22. Thus, the female housing 30 is positioned in the front-rear direction and moves to the right without interfering with the tabs. The follower 32 reaches the front end of the first guide groove 21 at the same time as butting against a back end part (right end part) of the second guide groove 22 to restrict further rightward movement of the female housing 30. At this time, the entire female housing 30 corresponds to an internal space of the receptacle 12 in the lateral direction and the female housing 30 does not protrude left from the receptacle 12.

Figure 7:
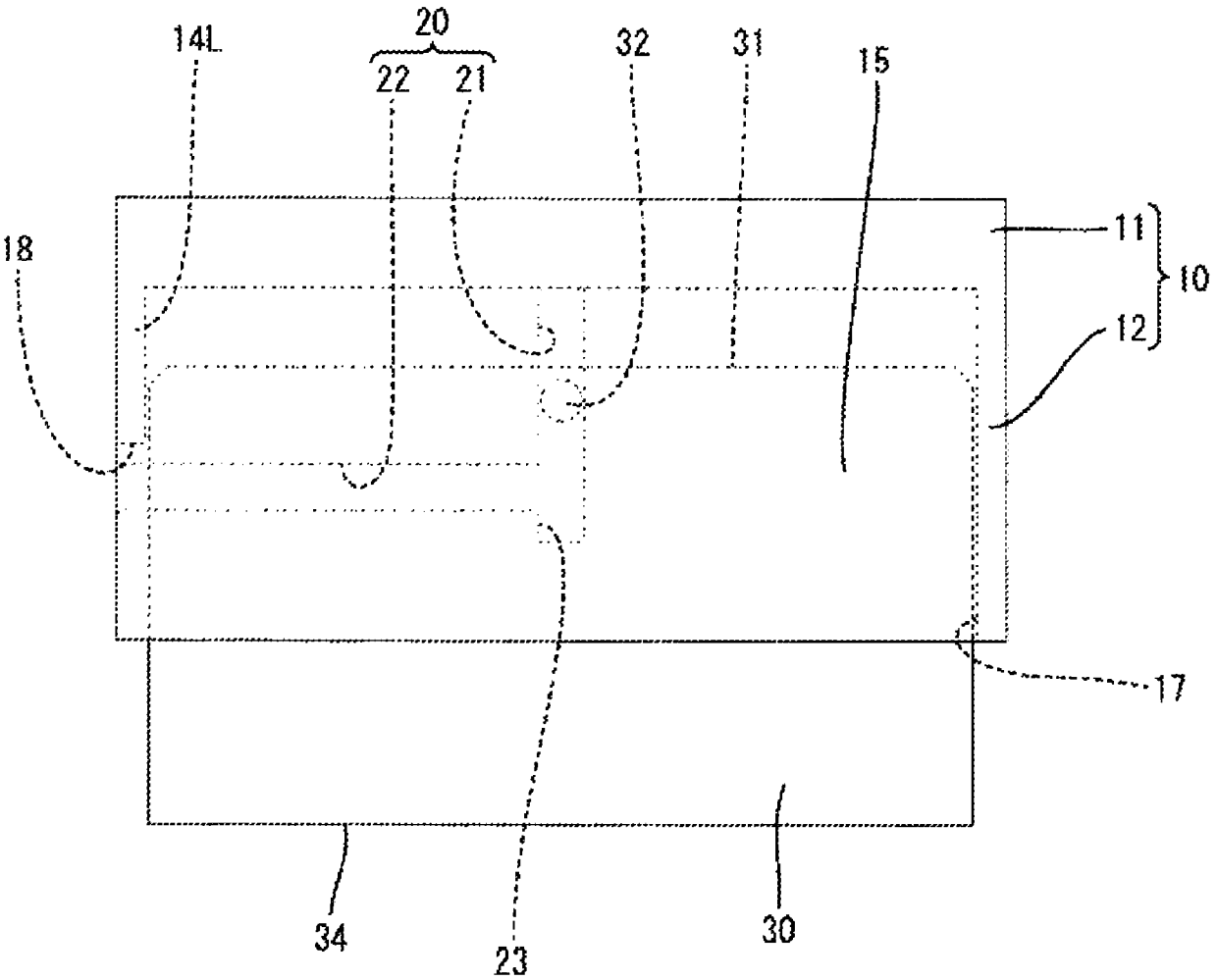
FIG. 7 is a bottom view showing the process of connecting the female housing to the male housing.
Figure 8:
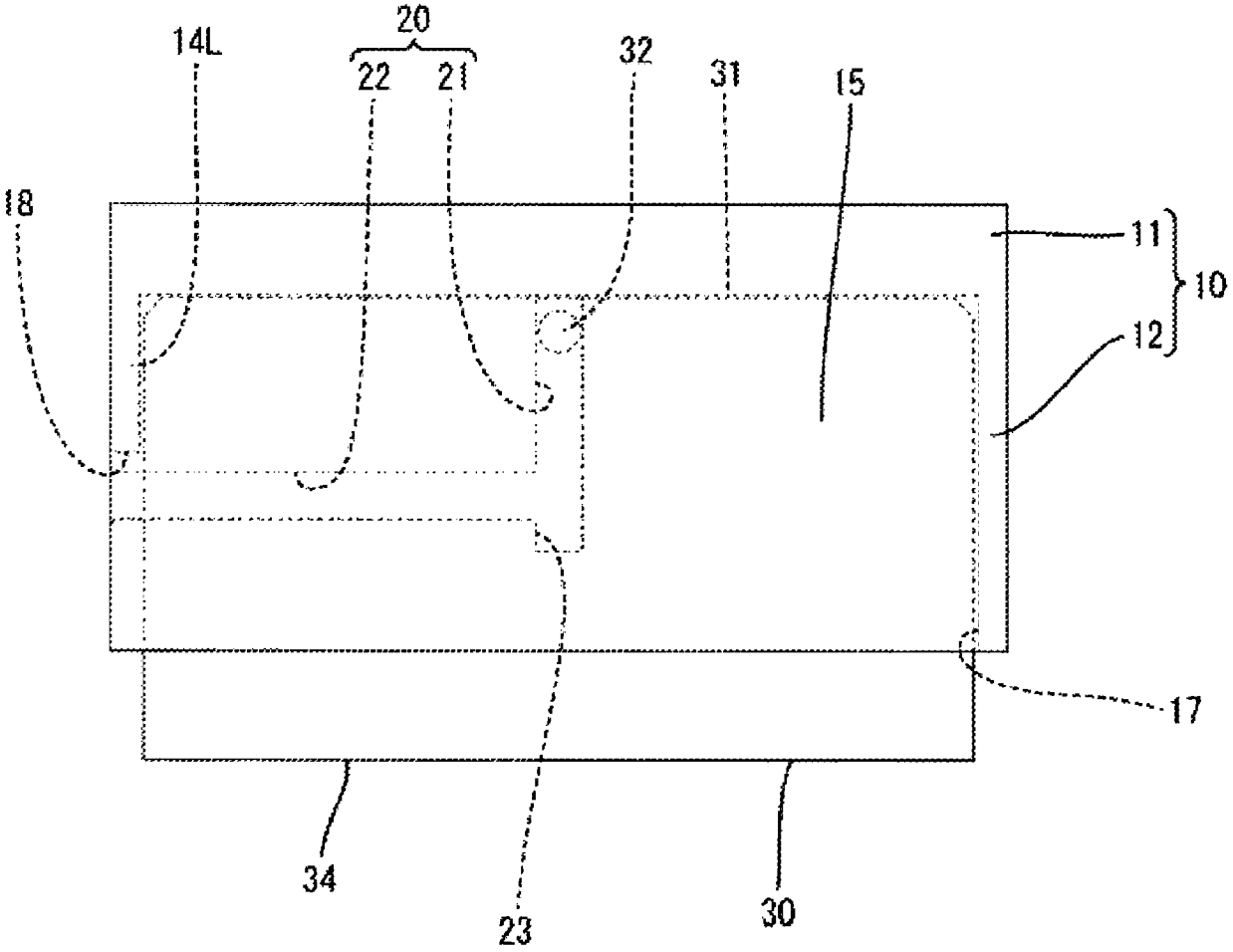
FIG. 8 is a bottom view showing the state where the male and female housings are properly connected.

Thereafter, the female housing 30 is pushed to a back part of the receptacle 12. During this time, the follower 32 moves in the first guide groove 21, as shown in FIG. 7. Thus, the female housing 30 is positioned in the lateral direction and does not interfere with the left side wall 14L. While the follower 32 is moving in the first guide groove 21, the lock arm 33 is resiliently deflected in an unlocking direction due to the interference of the lock projection 35 with the lock 16. The lock arm 33 resiliently returns when the housings 10, 30 reach a properly connected state, as shown in FIG. 8, and the lock projection 35 and the lock 16 are locked to each other, as shown in FIG. 5. By this locking action, the housings 10, 30 are locked in a state where their separation is restricted. At this time, the operating portion 36 is exposed to the outside of the receptacle 12.

Figure 9:
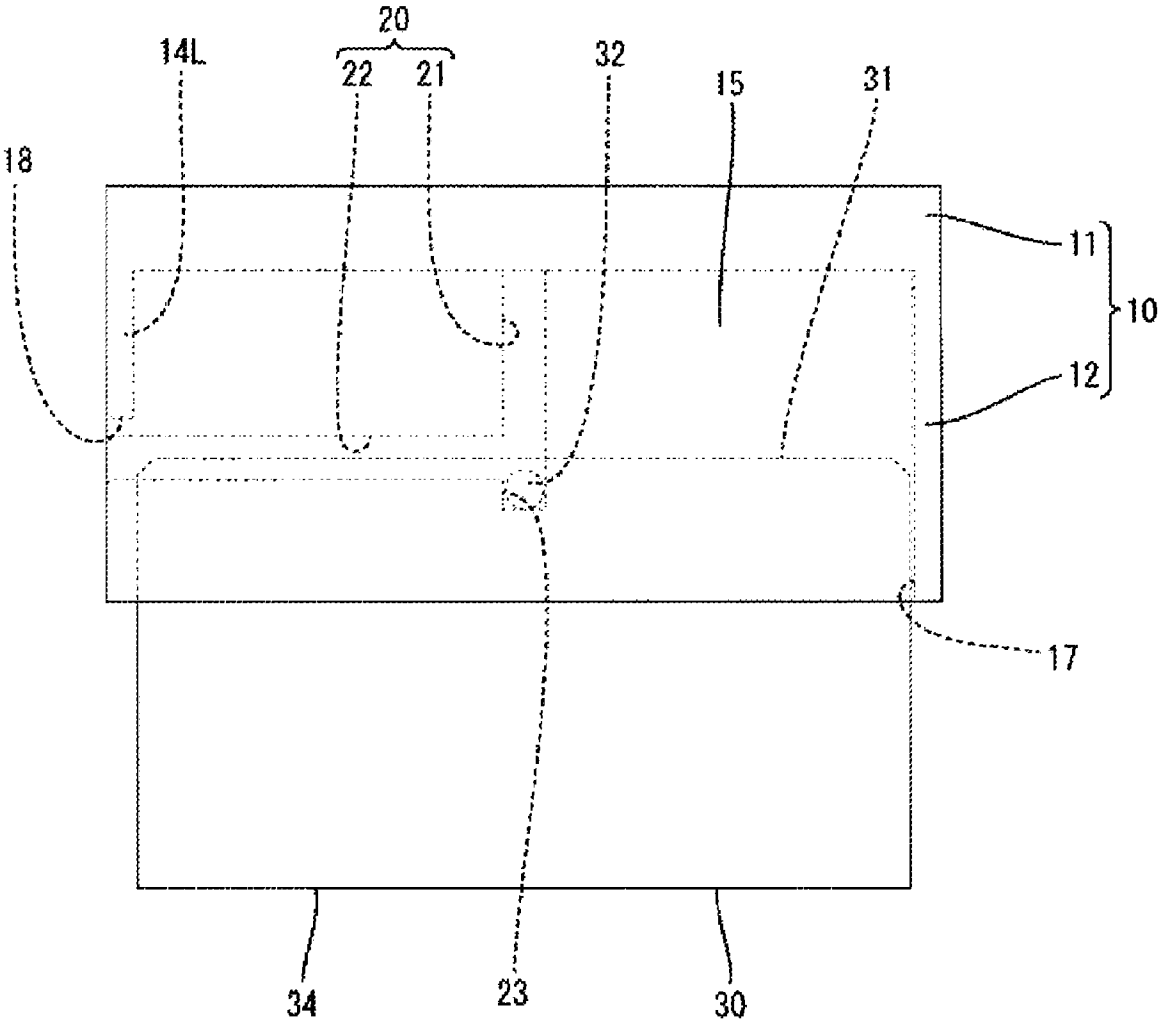
FIG. 9 is a bottom view showing a state where a follower portion is fit in a recess in separating the female housing from the male housing.

The housings 10, 30 that have been locked in the properly connected state can be separated by pushing the operating portion 36 in the unlocking direction to unlock the lock projection 35 and the lock 16. Thereafter, the female housing 30 is pulled toward the back surface 34 with the operating portion 36 kept pushed to unlock. During this time, the follower 32 moves in the first guide groove 21, as shown in FIG. 7. If the female housing 30 is pulled farther toward the back surface 34 in that state, the follower 32 enters the recess 23 in the front part of the first guide groove 21 and butts against the front end surface of the recess 23 as shown in FIG. 9.

The front end part of the first guide groove 21 is a dead-end. Thus, even if the female housing 30 is pulled strongly toward the back surface 34 (in a direction to be separated forwardly from the receptacle 12) as in a normal separating operation, any further forward movement of the female housing 30 toward the back surface 34 is restricted and the female housing 30 cannot be pulled out of the receptacle 12 (both housings 10, 30 cannot be separated). That is, a general user who does not recognize that the front end part of the first guide groove 21 is a dead-end cannot separate the housings 10, 30 even if being able to unlock the properly connected state.

Further, the recess 23 is arranged in front of the first guide groove 22. Thus, the follower 32 that is inserted in the recess 23 is located between left and right inner surfaces of the recess 23. Therefore, the female housing 30 cannot move forward, left and right. A general user who does not recognize the presence of the recess 23, may notice that a left part of the female housing 30 is exposed in the cut 18 and may try to slide the female housing 30 to the left. However, the female housing 30 does not move.

The separating operation proceeds from a state where the follower 32 is inserted in the recess 32, by returning the female housing 30 slightly toward the back of the receptacle 12 (toward the front surface 31 of the female housing 30) while a force acting in a leftward direction (direction toward the cut 18) is applied to the female housing 30. The female housing 30 starts moving to the left when the follower 32 comes out of the recess 23 and reaches a position corresponding to the second guide groove 22. Since the follower portion 32 moves in the second guide groove 22 while the female housing 30 is moving leftward, the female housing 30 does not interfere with the left side wall 14L. If the female housing 30 continues to be moved after the follower 32 comes out of the second guide groove 22, the housings 10, 30 are separated.

The connector of this embodiment includes the male housing 10, the receptacle 12 formed in the male housing 10 and having the front surface serving as the opening 17, the cut 18 formed by cutting a part of the left side wall 14L constituting the receptacle 12 to communicate with the opening 17 and configured to allow the passage of the female housing 30, and the female housing 30 to be fit into the receptacle 12 to close the opening 17.

The male housing 10 and the female housing 30 are formed respectively with the lock 16 and the lock arm 33 as the lock means capable of locking the housings 10, 30 in the properly connected state and unlocking the housings 10, 30. Further, the inner surface of the receptacle 12 is formed with the first guide groove 21 extends in the front-rear direction from the position behind the front end of the receptacle 12 toward the back end of the receptacle 12 and the second guide groove 22 extends in a direction intersecting a length direction of the first guide groove 21 from the front of the first guide groove 21 toward the cut 18. The follower 32 is formed on the outer surface of the female housing 30 and guides the female housing 30 from a proper connection position to the male housing 10 to the cut 18 by successively sliding in contact with the first and second guide grooves 21, 22 is.

Accordingly, in separating the housings 10, 30, the lock arm 33 and the lock 16 are unlocked and the female housing 30 is slid toward the front end of the receptacle 12 along the first guide groove 21. When the follower 32 reaches the front of the first guide groove 21, any further forward movement of the female housing 30 is restricted. Thus, a general user or the like who does not recognize a guiding structure composed of the first and second guide grooves 21, 22 cannot easily separate the housings 10, 30 even if being able to unlock the lock arm 33 and the lock 16.

In contrast, a mechanic or the like who recognizes the guiding structure composed of the first and second guide grooves 21, 22 can separate the female housing 30 from the male housing 10 by sliding the female housing 30 toward the cut 18 and causing the female housing 30 to pass through the cut 18 after the follower portion 32 reaches the front end part of the first guide groove 21. Thus, in the connector of this embodiment, the housings 10, 30 in the connected state cannot be easily separated.

Further, if first and second guides communicate at an obtuse angle, a follower portion having reached a front end part of the first guide portion may be guided to the second guide portion by a forward operating force applied to a female housing. However, the first and second guide grooves communicate at a right angle in the connector of this embodiment, even if the follower 32 reaches the front of the first guide groove 21 with a forward operating force applied to the female housing 30. Thus, there is no possibility that the follower portion 32 is guided to the second guide. Therefore, it is difficult to easily separate the housings 10, 30.

Further, the front end part of the first guide groove 21 is formed with the recess 23 extending farther forward than a communication position with the second guide groove 22. According to this configuration, if the female housing 30 is slid forward from the state where the housings 10, 30 are connected, a forward movement of the female housing 30 is stopped when the follower 32 reaches the recess 23 after passing the communication position with the second guide groove. Since the follower portion 32 cannot enter the second guide groove 22 if left in this state, a general user or the like who does not recognize the presence of the recess 23 cannot slide the female housing 30 toward the cut 18. Therefore, it is difficult to easily separate the both housings 10, 30.

The invention is not limited to the above described and illustrated embodiment. For example, the following embodiments also are included in the scope of the invention.

Although the recess is formed in the front end part of the first guide groove in the above embodiment, such a recess may not be formed.

Although the first and second guide grooves communicate at a right angle in the above embodiment, the first and second guide grooves may communicate at an acute or obtuse angle.

Although the second guide groove extends straight in the above embodiment, the second guide groove may be a path including a curved part.

Although the first guide groove is arranged at the central position in the width direction in the above embodiment, the first guide groove may be arranged at a position displaced to either left or right side from the center in the width direction.

Although the follower is arranged on a front end part (position near a connection surface) of the female housing in the front-rear direction in the above embodiment, the follower may be arranged in a central part, a rear end part or the like in the front-rear direction.

Although the follower is cylindrical in the above embodiment, the follower may be a rectangular column.

Although the female housing is formed with the resiliently deflectable lock arm in the above embodiment, the male housing including the receptacle may be formed with a resiliently deflectable lock arm.

LIST OF REFERENCE SIGNS

10 . . . male housing
12 . . . receptacle
14L . . . left wall (peripheral wall)
16 . . . lock
17 . . . opening
18 . . . cutn
21 . . . first guide groove
22 . . . second guide groove
23 . . . recess
30 . . . female housing
32 . . . follower
33 . . . lock arm

The invention claimed is:

1. A connector, comprising:

a male housing;

a receptacle formed in the male housing and having a front opening;

a female housing to be fit into the receptacle to close the opening;

a cut formed by cutting a part of a peripheral wall of the receptacle to communicate with the opening and configured to allow passage of the female housing;

a lock capable of locking the male housing and the female housing in a properly connected state and unlocking the male and female housings;

a first guide groove formed in an inner surface of the receptacle and extending in a front-rear direction from a position behind a front end of the receptacle toward a back end of the receptacle;

a second guide groove formed in the inner surface of the receptacle and extending in a direction intersecting with the first guide groove from a front end part of the first guide groove toward the cut; and a follower portion on an outer surface of the female housing and configured to guide the female housing from a proper connection position to the male housing to the portion by successively sliding in contact with the first guide groove and the second guide groove.

2. The connector of claim 1, wherein the first guide groove and the second guide groove communicate at a right or acute angle.

3. The connector of claim 1, wherein a recess extending farther forward than a communication position with the second guide groove is formed in the front end part of the first guide groove.

4. The connector of claim 1, wherein a recess extending farther forward than a communication position with the second guide groove is formed in the front end part of the first guide groove.

* * * * *